US008393691B2

(12) United States Patent
Diebold et al.

(10) Patent No.: US 8,393,691 B2
(45) Date of Patent: Mar. 12, 2013

(54) HINGE PULLEY FOR DOMESTIC HOUSEHOLD APPLIANCE

(75) Inventors: Steffen Diebold, Hermaringen (DE); David Hite, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 372 days.

(21) Appl. No.: 12/750,797

(22) Filed: Mar. 31, 2010

(65) Prior Publication Data

US 2011/0241507 A1 Oct. 6, 2011

(51) Int. Cl.
*A47B 77/00* (2006.01)

(52) U.S. Cl. ..... 312/228; 312/319.1

(58) Field of Classification Search ..... 312/228, 312/319.1, 319.2, 319.4, 327, 328, 311; 126/191, 126/194; 49/381, 386, 387; 16/78, 81, 286, 16/289, 306

See application file for complete search history.

(56) References Cited

U.S. PATENT DOCUMENTS

| | | | | |
|---|---|---|---|---|
| 5,980,006 | A * | 11/1999 | Wilhelmstatter et al. | 312/319.1 |
| 6,487,780 | B1 * | 12/2002 | Peterson et al. | 30/347 |
| 2007/0015869 | A1 * | 1/2007 | Ratnagiri et al. | 525/55 |
| 2008/0272678 | A1 * | 11/2008 | Tynes et al. | 312/319.4 |

* cited by examiner

*Primary Examiner* — James O Hansen
(74) *Attorney, Agent, or Firm* — James E. Howard; Andre Pallapies

(57) ABSTRACT

A hinge pulley for a household appliance having a housing, a washing container in the housing, a door pivotable about a horizontal axis at the lower part of the door between an open and a closed position for accessing an interior of the washing container, and a transmission element coupled between the door and the housing. The hinge pulley includes a unitary molded body having an integral first channel having a first curved portion for guiding the transmission element, and an integral second channel having a second curved portion for guiding the transmission element, wherein a portion of one of the integral first channel and the integral second channel includes a sliding surface formed from an ultra high molecular weight material.

20 Claims, 12 Drawing Sheets

HINGE PULLEY FOR DOMESTIC HOUSEHOLD APPLIANCE

FIELD OF THE INVENTION

The present invention is directed to a hinge pulley, and more particularly, to a hinge pulley for a domestic household appliance, and more particularly, to a hinge pulley for a dishwasher.

BACKGROUND OF THE INVENTION

A household appliance, such as a dishwasher, includes a housing having a washing container for washing crockery therein. The washing container commonly includes a plurality of crockery baskets for holding the crockery to be washed. The washing container includes one or more spray devices for wetting the crockery to be washed. The household appliance includes a door that provides access to the washing container in the interior of the appliance housing. The door commonly is pivotable about a horizontal axis at the lower part of the door.

The door may be supported, for example on each side, by a rope or cable connected to a horizontal spring inside the housing. A hinge pulley and a transmission element commonly are provided to transmit the horizontal movement of the spring into vertical force applied to the door, thereby assisting in the movement of the door from the open position to the closed position, and vice versa.

As illustrated in FIGS. 12A-12C, a conventional hinge pulley 1 commonly includes a first housing part 10 and a second housing part 12 coupled together to support a rotating pulley wheel 14 therebetween. As shown in FIGS. 12A-12C and 13, in an assembled state, a portion of a transmission element 18, such as a rope or cable, rests under tension on the pulley wheel 14 and wraps around a portion of the pulley wheel 14. Another portion of the transmission element 18 rests under tension on an upper bearing surface 16 of the first housing part 10 and wraps around a portion of the bearing surface 16. The transmission element 18 commonly includes a first end that is fastened to a tension spring, which in turn is coupled to the housing of the appliance, and a second end that is coupled to the door of the appliance. During operation, the transmission element 18 is guided by the rotating pulley wheel 14 and the upper bearing surface 16 as the door is opened or closed.

As shown in FIG. 13, the dishwasher can include a setting screw 15 that contacts a bearing surface of the hinge pulley for adjusting the spring tension of the hinge pulley, for example, for doors having different weights, decor panels, etc.

SUMMARY OF THE INVENTION

The present invention recognizes that it is desirable to reduce the number of parts of the hinge pulley, and more particularly, to reduce or eliminate moving parts, such as the rotating pulley wheel, that may be susceptible to wear and/or failure, thereby simplifying the assembly process of the hinge pulley, reducing manufacturing and assembly costs, and improving the durability of the hinge pulley.

The present invention also recognizes that it is desirable to provide a hinge pulley that is formed from a unitary, injection molded structure that minimizes the mold parts and mold slides needed to form the hinge pulley, thereby minimizing or reducing investment costs for the part.

Moreover, the present invention recognizes that it is desirable to provide a hinge pulley that can be transported either in the factory or from the manufacturer in an assembled state with the transmission element. The present invention also recognizes that it is desirable to provide a hinge pulley that can be coupled easily to the hinge plate of the appliance without tools or fasteners, and that minimizes or prevents incorrect or reverse installation of the hinge pulley.

These problems and others are addressed by the present invention, a first exemplary embodiment of which comprises a hinge pulley for a household appliance having a housing, a washing container in the housing, a door pivotable about a horizontal axis at the lower part of the door between an open and a closed position for accessing an interior of the washing container, and a transmission element coupled between the door and the housing. The hinge pulley includes a unitary molded body having an integral first channel having a first curved portion for guiding the transmission element, and an integral second channel having a second curved portion for guiding the transmission element, wherein a portion of one of the integral first channel and the integral second channel includes a sliding surface formed from an ultra high molecular weight material.

Another exemplary embodiment of the invention comprises a household appliance comprising a housing; a washing container in the housing; a door pivotable about a horizontal axis at the lower part of the door between an open and a closed position for accessing an interior of the washing container, a transmission element coupled between the door and the housing, and a hinge pulley coupled to the housing, wherein the hinge pulley includes an integral first channel having a first curved portion guiding a first portion of the transmission element; and an integral second channel having a second curved portion guiding a second portion of the transmission element; wherein a portion of one of the integral first channel and the integral second channel includes a sliding surface formed from an ultra high molecular weight material.

A further exemplary embodiment of the invention comprises a hinge pulley assembly for a household appliance having a housing, a washing container in the housing, a door pivotable about a horizontal axis at the lower part of the door between an open and a closed position for accessing an interior of the washing container, and a transmission element coupled between the door and the housing, the hinge pulley assembly comprising a hinge pulley having a unitary molded body including an integral first channel having a first curved portion for guiding the transmission element; and an integral second channel having a second curved portion for guiding the transmission element; wherein a portion of one of the integral first channel and the integral second channel includes a sliding surface formed from an ultra high molecular weight material; and the transmission element coupled between the door and the housing and having a first portion resting on the integral first channel and a second portion resting on the integral second channel of the hinge pulley.

In this manner, the present invention provides a hinge pulley that includes a fixed bearing surface while still maintaining low friction and durability. The exemplary embodiments provide a hinge pulley that reduces or minimizes the number of parts of the hinge pulley and reduces or eliminates moving parts, such as the rotating pulley wheel, thereby simplifying the assembly process of the hinge pulley, reducing manufacturing and assembly costs, and improving the durability of the hinge pulley. The exemplary embodiments also provides a hinge pulley that is formed from a unitary, injection molded structure that minimizes the mold parts and mold slides needed to form the hinge pulley, thereby minimizing or reducing investment costs for the part. Moreover, the exemplary embodiments also provide a hinge pulley that can be transported either in the factory or from the manufacturer in an assembled state with the transmission element. The exemplary embodiments provide a hinge pulley that can be coupled easily to the hinge plate of the appliance without tools or fasteners, and that minimizes or prevents incorrect or reverse installation of the hinge pulley.

For purposes of this disclosure, an ultra high molecular weight material includes, for example, an ultra high molecular weight polyethylene (UHMW-PE or sometimes shortened to UHMW, also known as high-modulus polyethylene (HMPE) or high-performance polyethylene (HPPE)), or the like formed from a subset of the thermoplastic polyethylene.

An exemplary ultra high molecular weight material can include, for example, PE Hostalen GUR x150, as well as other commercially available UHMW-PE materials, or materials identified, for example, in ASTM D4020-05-Standard Specification for Ultra-High-Molecular-Weight Polyethylene Molding and Extrusion Materials, ISO standards, etc.

Such ultra high molecular weight material preferably has extremely low moisture absorption, has a very low coefficient of friction, is self-lubricating, and is highly resistant to abrasion (e.g., approximately 15 times more resistant to abrasion than carbon steel). The ultra high molecular weight material preferably has a coefficient of friction that is significantly less than the coefficient of friction of nylon and acetal, and that is comparable to that of Teflon, and more particularly, with improved abrasion resistance over Teflon. The ultra high molecular weight material preferably is odorless, tasteless, and nontoxic. The ultra high molecular weight material also preferably is highly resistant to many corrosive chemicals.

In an exemplary embodiment, the entire hinge pulley, or a substantial portion thereof, is formed from injected molded ultra high molecular weight material. However, the present invention recognizes that the cost and complexity of forming the exemplary hinge pulley can be reduced, for example, by forming a substantial portion of the hinge pulley from a less expensive and more easily molded material, such as polyoxymethylene (commonly referred to as POM), and then overmolding only a portion of the hinge pulley with the ultra high molecular weight material.

For purposes of this disclosure, polyoxymethylene (commonly referred to as POM and also known as polyacetal or polyformaldehyde) can include, for example, an engineering thermoplastic that is suitable for use in precision parts requiring high stiffness, low friction and excellent dimensional stability. In an exemplary embodiment, the base of the hinge pulley can be formed, for example, from POM Hostaform C 9021, as well as other commercially available POM materials, or materials identified, for example, in ASTM D6778-06-Standard Classification for Polyoxymethylene (POM, Acetal) Molding and Extrusion Materials, ISO 9988-2:2006, etc.

In an exemplary embodiment, only the sliding surfaces of the hinge pulley are overmolded with the ultra high molecular weight material, thereby minimizing the quantity of ultra high molecular weight material and reducing the cost and complexity of the hinge pulley.

In another exemplary embodiment, the sliding surfaces that are overmolded with the ultra high molecular weight material can include curved, circular, or oval portions that extend substantially 180° around the integral first and second channels. In this manner, the exemplary hinge pulley can be formed as a single part using a simplified mold. Moreover, the areas where the transmission element slides over the channels of the hinge pulley can be resistant to wear and can provide a low friction surface for the sliding of the transmission element.

In an exemplary embodiment, the 180° edge of the overmold of UHMW material for the upper channel can be substantially parallel to the 180° edge of the overmold of UHMW material for the lower channel. The upper channel surface inside the upper fixation feature can be substantially perpendicular to the 180° edge of the overmold of UHMW material for the upper channel and/or the 180° edge of the overmold of UHMW material for the lower channel. In this manner, these exemplary embodiments can provide a hinge pulley that is capable of being formed using a two-piece mold.

In another embodiment, the surfaces of one or more of the channels, which are formed from the POM material, can include a trough, recess, or the like corresponding to the sliding surfaces. In this manner, the hinge pulley can be formed, for example, using a two-step process. First, the hinge pulley having the channels and troughs or recesses corresponding to the sliding surfaces can be formed from the POM material. Second, the sliding surfaces can be formed on the hinge pulley by overmolding the UHMW material into the troughs or recesses such that the sliding surfaces of the UHMW material substantially correspond to the adjacent surfaces of the channels of POM material, thereby forming a substantially smooth transition between the POM material and the UHMW material in the channels. The troughs or recesses may improve gripping of the UHMW material to the adjacent surfaces of the POM material.

In an exemplary embodiment, the hinge pulley can include a first (i.e., upper) fixation guide through which the transmission element is inserted to secure the transmission element to the hinge pulley. The hinge pulley can include a second (i.e., lower) fixation guide through which the transmission element is inserted to secure the transmission element to the hinge pulley.

In an embodiment, the hinge pulley can include an axle about which the hinge pulley can pivot. The axle can include a first tab on one side, and a second tab on the other side. In an exemplary embodiment, the first tab can be offset from the second tab by a predetermined angle with respect to a center of the axle. Particularly, the first tab can be offset from the second tab such that the first and second tabs do not overlap each other in the axial direction. In this manner, the hinge pulley having the tabs can be injection molded as a single part using only a single mold having two slides for forming the tabs, thereby simplifying the mold design for forming the hinge pulley and correspondingly reducing costs.

A first side of the body of the dishwasher can include a stamped metal hinge plate having an opening for receiving the axle of the hinge pulley. The opening can include a slot that corresponds to the tab when the hinge pulley is installed correctly. During assembly, the tab and axle are aligned with the opening and the slot and inserted therein. The hinge pulley is then rotated upward into position such that the tab engages the surface of the metal hinge plate and locks the hinge pulley on the metal hinge plate. In this manner, the exemplary embodiment can provide a fastener-less hinge pulley that can be secured to the metal hinge plate without separate fastening means, such as screws or snap features.

Since the tabs are offset from each other, and since the slots correspond to the position of the respective offset tab, the exemplary embodiment can minimize or prevent the incorrect installation of the hinge pulley on the metal hinge plate. For example, if the hinge pulley is installed incorrectly, the hinge pulley interferes with the metal hinge plate such that the hinge pulley cannot rotate properly into the locked position.

In another embodiment, the hinge pulley can include a notch formed in each sidewall on a side that is adjacent to the sliding surface. The notch can receive the transmission element therein and hold the transmission element to assist assembly and prevent the transmission element from exiting or being withdrawn from the first fixation guide. In an exemplary embodiment, the notch can include a narrow portion through which the transmission element is forced through and a larger cutout portion for holding the transmission element therein without pinching the transmission element.

In operation, the transmission element can be installed in the fixation guide of the hinge pulley prior to installation of the hinge pulley onto the household appliance on the assembly line. The transmission element can be forced into the notch and into the cutout portion such that the transmission element is held therein without pinching the transmission element. In this manner, one of the notches can be used to hold the transmission element during transport of the assembled hinge pulley and transmission element to the assembly line. Alternatively, a vendor or supplier easily can ship the assembled hinge pulley and transmission element to the assembly plant, thereby avoiding a need for the hinge pulley and the transmission element to be assembled on the assembly line.

In an exemplary embodiment, a notch is formed on either side of the hinge pulley such that the transmission element can be secured on either side of the hinge pulley depending on which side of the appliance the hinge pulley is being installed upon. In this manner, the transmission element can be secured in the notch during the installation, thereby preventing the transmission element from withdrawing from the hinge pulley or interfering with the installation process.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
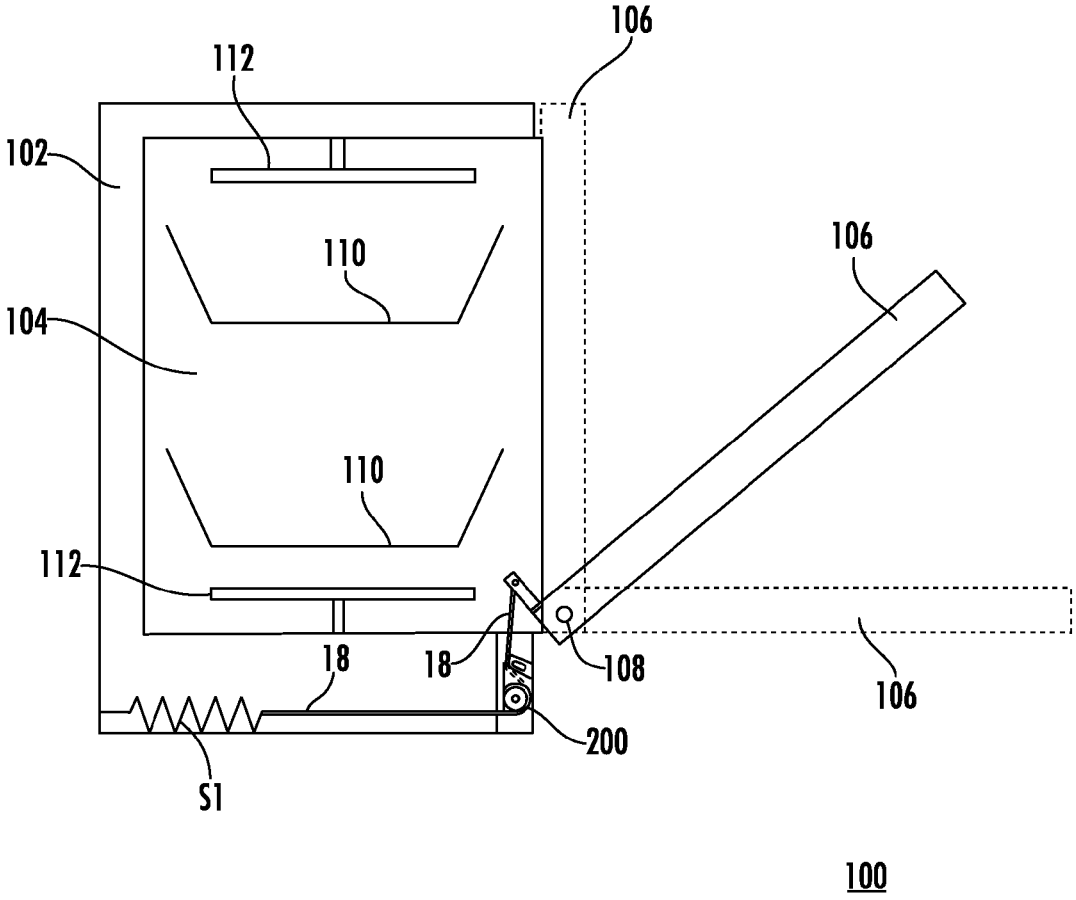
FIG. 1 is a schematic side view of a dishwasher.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-11 illustrate exemplary embodiments of a hinge pulley.

FIG. 1 illustrates a household appliance, such as a domestic dishwasher 100. The domestic dishwasher 100 can include a housing 102 having a washing container 104 for washing crockery, cutlery, etc. therein. The washing container 104 commonly includes a plurality of crockery baskets 110 for holding the crockery to be washed. The washing container 104 can include one or more spray devices 112 for wetting the crockery to be washed.

The dishwasher 100 includes a door 106 that provides access to the washing container 104 in the interior of the appliance housing 102. The door 106 commonly is pivotable about a horizontal axis 108 at the lower part of the door 106 between an open and closed position (shown by dashed lines) for accessing the interior of the washing container 104. The door 106 is connected, in a conventional manner not described in more detail, to both sides of the front side of the housing 102, in each case by a hinge connected to the door 106.

The door 106 may be supported, for example, on each side by a transmission element 18 connected to a horizontal tension spring S1 coupled to the inside of the housing 102. A hinge pulley 200 can be provided to guide the transmission element 18 and transmit the horizontal movement of the tension spring S1 into vertical force applied to the door 106, thereby assisting in the movement of the door 106 from the open position to the closed position, and vice versa. The transmission element 18 can be, for example, a tape, rope, cable, or cord-shaped transmission element. For example, the transmission element 18 can be a thermoplastic cord, a braided cord, a polyester cord, a metal cord, a coated metal cord, or the like. The transmission element 18 commonly includes a first end 18A that is fastened to the tension spring S1, which in turn is coupled to the housing 102 of the appliance, and a second end 18B that is coupled to the door 106 of the appliance.

A hinge pulley 200 according to an exemplary embodiment of the invention will now be described with reference to FIGS. 2-6B.

Figure 2:
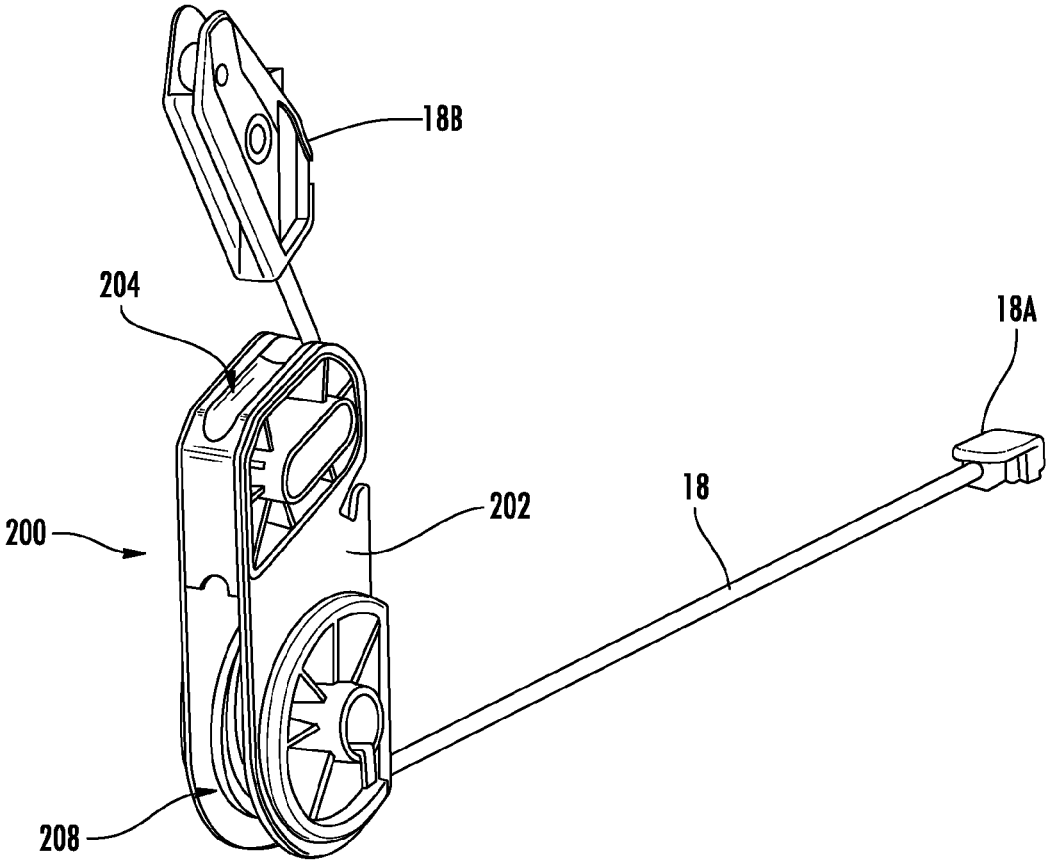
FIG. 2 is a perspective view of a hinge pulley assembly according to an exemplary embodiment of the invention.

As shown in FIG. 2, the hinge pulley 200 can include a unitary molded body 202 having a first sidewall 202A and a second sidewall 202B. The body 202 can include an integral first (i.e., upper) channel 204 and integral second (i.e., lower) channel 208 for guiding the transmission element 18. The channels 204, 208 can include, for example, a curved or concave surface when viewed in cross-section in a direction along the length of the channel. One of ordinary skill in the art will recognize that the surface is not limited to a curved surface, and can include, for example, a flat surface, a V-groove or V-shaped surface, or the like. In still other exemplary embodiments, the surface of the channels 204, 208 may include a convex portion within the channel, for example, in a case in which the transmission element is a flat tape.

In an assembled state, a portion of the transmission element 18 rests under tension on the integral first (i.e., upper) channel 204 and wraps around a portion of the integral first (i.e., upper) channel 204. Another portion of the transmission element 18 rests under tension on the integral second (i.e., lower) channel 208 and wraps around a portion of the integral second (i.e., lower) channel 208. During operation, the transmission element 18 slides over portions of the first (i.e., upper) channel 204 and second (i.e., lower) channel 208 of the hinge pulley as the door 106 is opened or closed.

Figure 3:
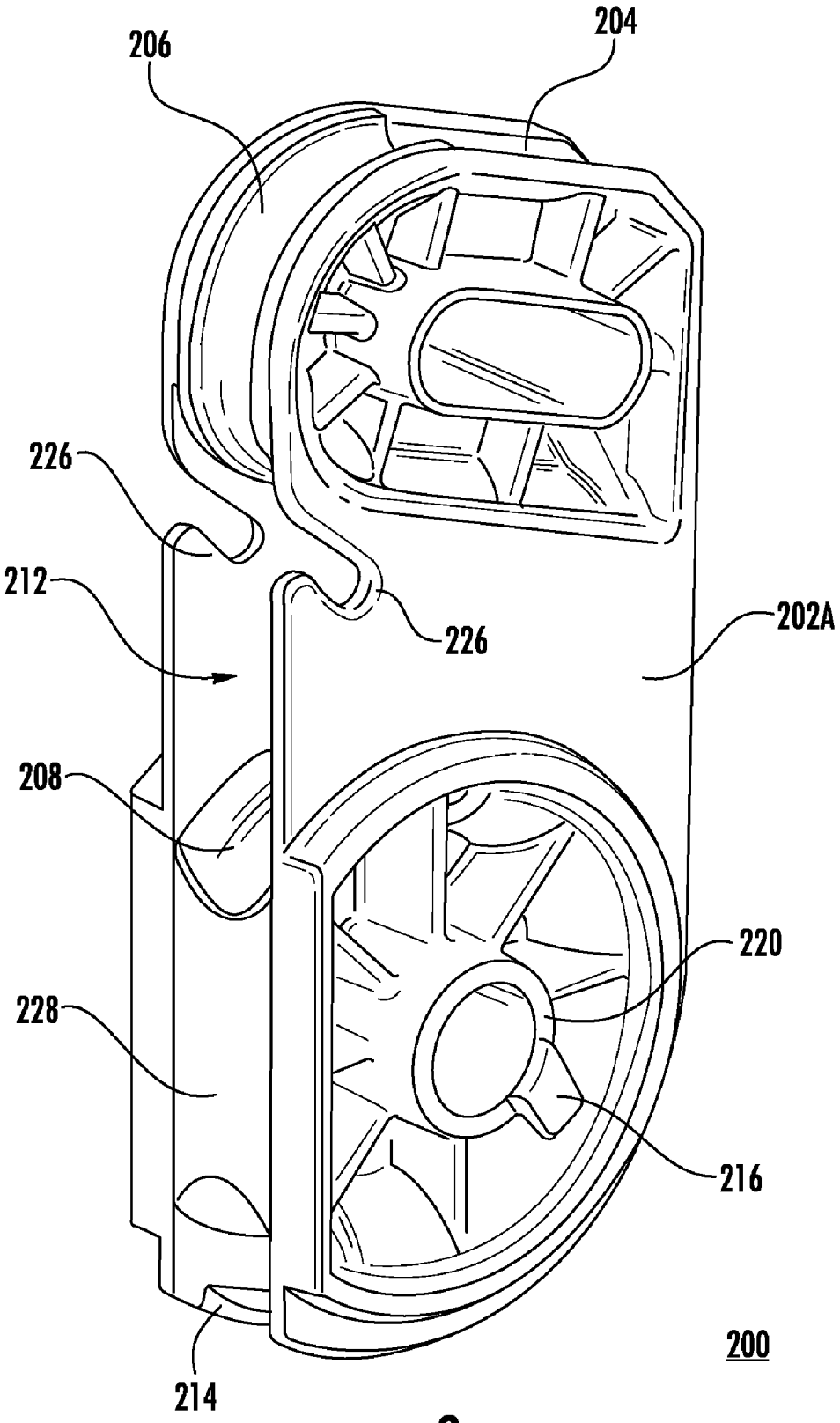
FIG. 3 is a perspective view of a hinge pulley according to an exemplary embodiment of the invention.
Figure 4:
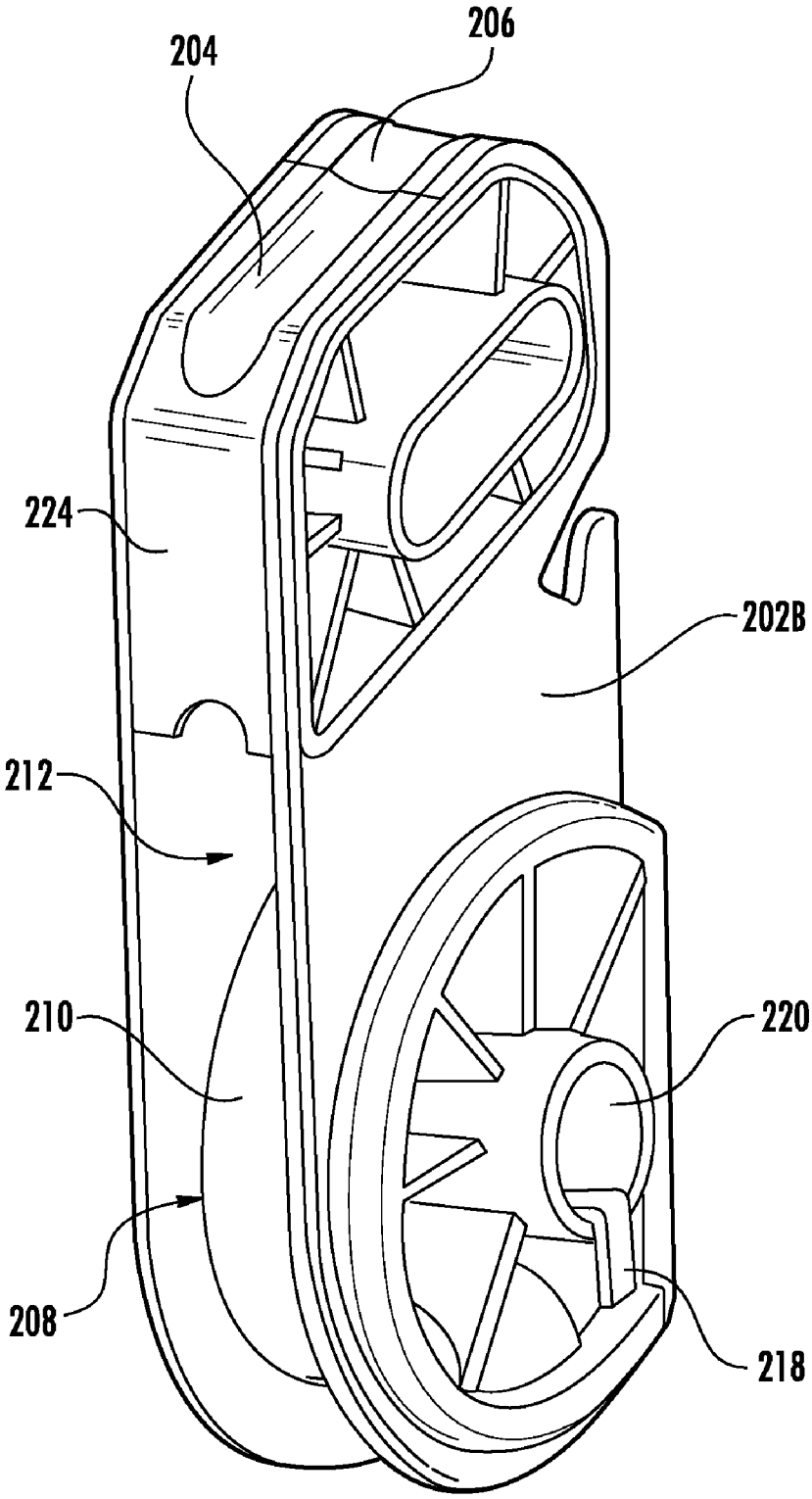
FIG. 4 is another perspective view of a hinge pulley according to an exemplary embodiment of the invention.
Figure 5:
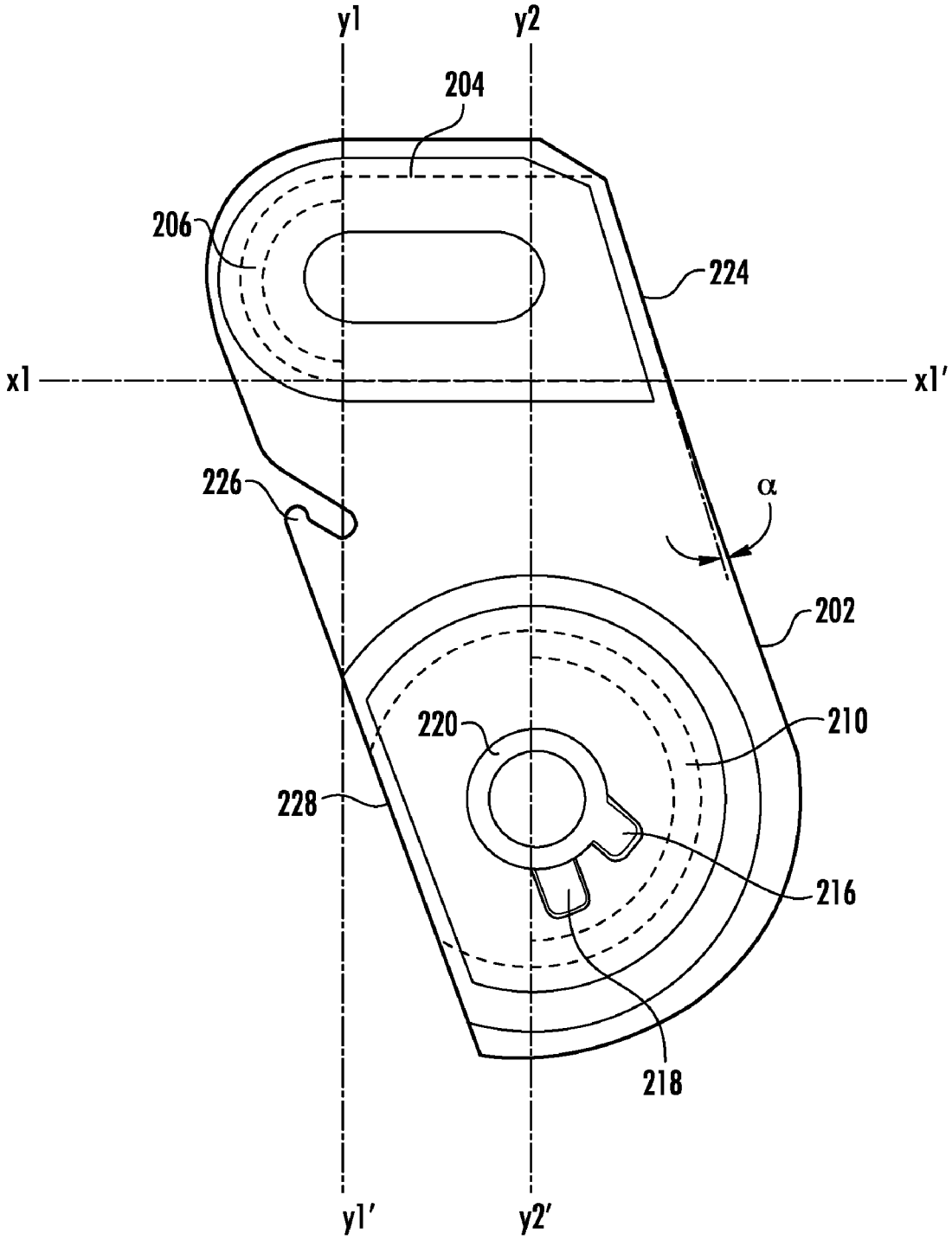
FIG. 5 is side view of a hinge pulley according to an exemplary embodiment of the invention.

FIGS. 3-5 illustrate an exemplary embodiment of the hinge pulley 200 without the transmission element 18 for clarity. The exemplary hinge pulley 200 can include, for example, a unitary molded body 202 having an integral upper channel 204 and integral lower channel 208 for guiding the transmission element 18. In an exemplary embodiment, the upper channel 204 can include sliding surface, such as curved, circular, or oval sliding surfaces 206, 210.

In an exemplary embodiment, the entire hinge pulley 200, or a substantial portion thereof, is formed from injected molded ultra high molecular weight (UHMW) material. In other embodiments, the hinge pulley can be formed from a first material overmolded with a second material. For example, in an embodiment, a substantial portion of the hinge pulley 200 can be formed from a polyoxymethylene material (commonly referred to as POM). The sliding surfaces 206, 210 can be formed by overmolding the POM material with an ultra high molecular weight (UHMW) material.

In an exemplary embodiment, only the sliding surfaces 206, 210 of the hinge pulley 200 are overmolded with the ultra high molecular weight (UHMW) material.

In another exemplary embodiment, as shown for example in FIG. 5, the sliding surfaces 206, 210 that are overmolded with the ultra high molecular weight (UHMW) material can include curved, circular, or oval portions that extend substantially 180° around the channel (e.g., 204, 208), as indicated by the dashed lines.

With reference to FIG. 5, in an exemplary embodiment, a line y1-y1' (which defines the 180° edge of the overmold of UHMW material for the upper channel) can be substantially parallel to the line y2-y2' (which defines the 180° edge of the overmold of UHMW material for the lower channel). The line x1-x1' (which defines the upper channel surface inside the upper fixation feature) can be substantially perpendicular to the lines y1-y1' and y2-y2'. In this manner, these exemplary embodiments can provide a hinge pulley that is capable of being formed using a two-piece mold.

As shown in FIG. 5, the surfaces of one or more of the channels 204, 208, which are formed from the POM material, can include a trough, recess, or the like corresponding to the sliding surfaces (e.g., 206, 210). The hinge pulley 200 can be formed, for example, using a two-step process. First, the hinge pulley 200 having the channels 204, 208 and troughs or recesses corresponding to the sliding surfaces 206, 210 can be formed from the POM material. Second, the sliding surfaces 206, 210 can be formed on the hinge pulley 200 by overmolding the UHMW material into the troughs or recesses such that the sliding surfaces 206, 210 of the UHMW material substantially correspond to the adjacent surfaces of the channels 204, 208 of POM material, thereby forming a substantially smooth transition between the POM material and the UHMW material in the channels 204, 208. The troughs or recesses may improve gripping of the UHMW material to the adjacent surfaces of the POM material.

With reference again to FIGS. 3-5, in an exemplary embodiment, the first channel 104 can be a substantially U-shaped channel when viewed from a side of the hinge pulley, as shown in FIG. 5. In a preferred embodiment, the first channel 104 can be a substantially U-shaped channel that is disposed at an incline with respect to a longitudinal axis (not shown) of the hinge pulley 200. One of ordinary skill in the art will recognize that the embodiments are not limited to the illustrated embodiments. For example, in other embodiments, the first channel 104 can be other shapes, such as a circle or portion of a circle.

In an embodiment, the second channel 208 can be substantially circular-shaped when viewed from a side of the hinge pulley 200, as shown in FIG. 5. In a preferred embodiment, the second channel 208 can be a portion of a circular shape. One of ordinary skill in the art will recognize that the embodiments are not limited to the illustrated embodiments, and the channel can have other shapes that are suitable for guiding the transmission element 18.

With reference again to FIGS. 3-5, the hinge pulley 200 can include a first (i.e., upper) fixation guide 212 through which the transmission element 18 is inserted to secure the transmission element 18 to the hinge pulley.

The upper fixation guide 212 can include an opening that is closed on four sides and open at each end for permitting the transmission element 18 to pass therethrough. The upper fixation guide 212 can be defined on a first side and a second side by the opposed surfaces of the first (i.e., upper) channel 204 and the second (i.e., lower) channel 208, and on a third side and a fourth side by opposed interior surfaces of the sidewalls 202A, 202B of the body 202 of the hinge pulley 200.

Figure 6A:
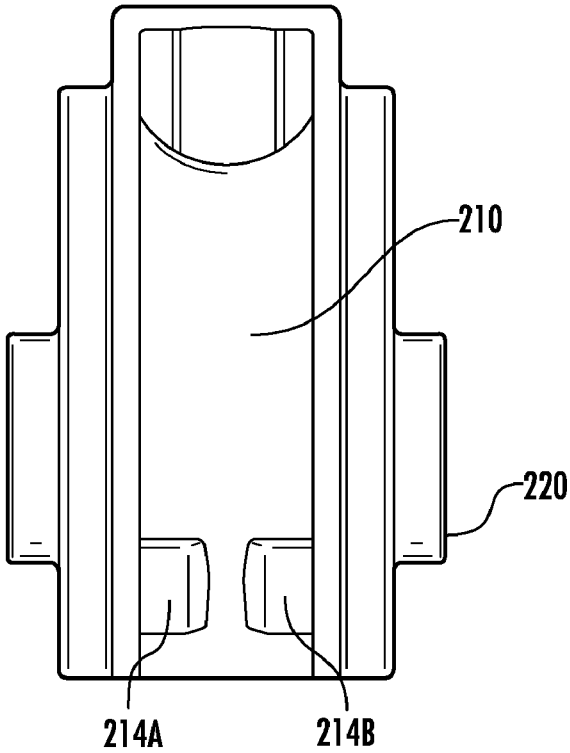
FIG. 6A is a bottom view of a hinge pulley according to an exemplary embodiment of the invention.
Figure 6B:
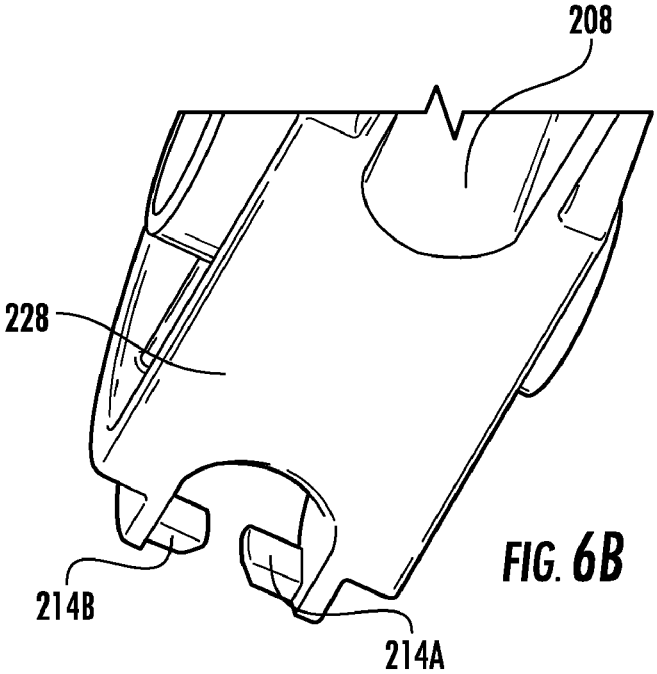
FIG. 6B is a partial perspective view of a hinge pulley according to an exemplary embodiment of the invention.

With reference to FIGS. 3, 6A, and 6B, the hinge pulley 200 can include a second (i.e., lower) fixation guide 214 through which the transmission element 18 is inserted to secure the transmission element 18 to the hinge pulley 200. The fixation guide 214 can be disposed at a lower portion of the hinge pulley 200, and more particular, adjacent to an end portion of the channel 208 of the hinge pulley 200, at which the transmission element 18 exits the channel 208 and extends toward the tension spring S1 during operation.

In an exemplary embodiment, the fixation guide 214 can include a pair of tabs 214A, 214B separated by a gap, such that the transmission element 18 can be slipped between the tabs 214A, 214B, and into the fixation guide 214 without having to remove the ends of the transmission element 18. The ends of the tabs 214A, 214B can be tapered on an outer surface to promote slipping of the transmission element 18 between the tabs 214A, 214B. The inner surfaces of the tabs 214A, 214B can be formed, for example, at 90° angles to hinder a slippage of the transmission element 18 from within the fixation guide 214 back out through the gap between the tabs 214A, 214B.

With reference to FIGS. 3-5 and 7A-8B, an exemplary embodiment of a hinge pulley 200, and particularly, a fastener-less hinge pulley, and a method of mounting the fastener-less hinge pulley 200 on a hinge plate 120A, 120B of a household appliance will now be described.

As shown in FIGS. 3-5, the hinge pulley 200 can include an axle 220 about which the hinge pulley 200 can pivot. The axle 220 can include a first tab 216 on one side, and a second tab 218 on the other side. In an exemplary embodiment, as shown for example in FIG. 5, the first tab 216 can be offset from the second tab 218 by a predetermined angle with respect to a center of the axle 220. Particularly, the first tab 216 can be offset from the second tab 218 such that the first and second tabs 216, 218 do not overlap each other in the axial direction. In this manner, the hinge pulley 200 having the tabs 216, 218 can be injection molded as a single part using only a single mold having two slides for forming the tabs 216, 218, thereby simplifying the mold design for forming the hinge pulley 200 and correspondingly reducing costs.

Figure 7A:
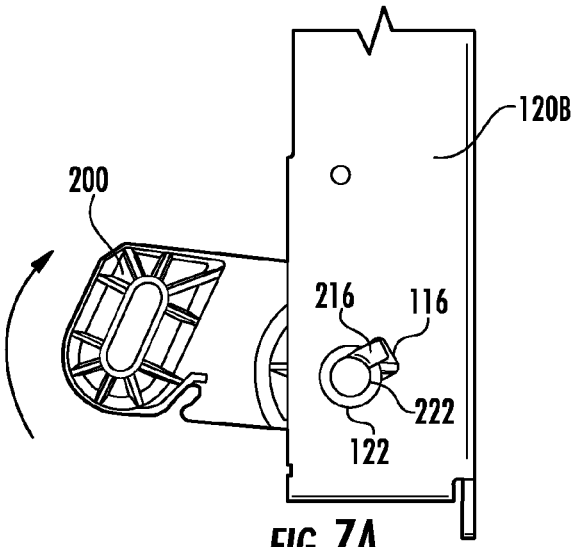
FIG. 7A is a partial side assembly view of a hinge pulley and hinge plate according to an exemplary embodiment of the invention.
Figure 7B:
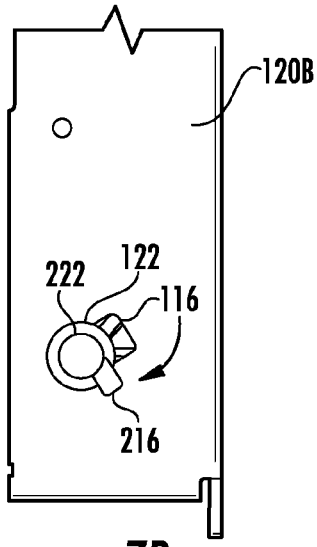
FIG. 7B is a partial side assembly view of a hinge pulley and hinge plate of FIG. 7A.

As shown in FIGS. 7A and 7B, a first side of the housing 120 of the dishwasher can include a stamped metal hinge plate 120A having an opening 122 for receiving the axle 220 of the hinge pulley 200. The opening 122 can include a slot 116 that corresponds to the tab 216 when the hinge pulley 200 is installed correctly.

During assembly, the tab 216 and axle 220 are aligned with the opening 122 and the slot 116 and inserted therein, as shown in FIG. 7A. The hinge pulley 200 is then rotated upward (i.e., counter-clockwise in FIG. 7A as shown by the arrow) into position such that the tab 216 engages the surface of the metal hinge plate 120A and locks the hinge pulley 200 on the metal hinge plate 120A, as shown in FIG. 7B. In this manner, the exemplary embodiment can provide a fastener-less hinge pulley 200 that can be secured to the metal hinge plate 120A without separate fastening means, such as screws or snap features.

Figure 8A:
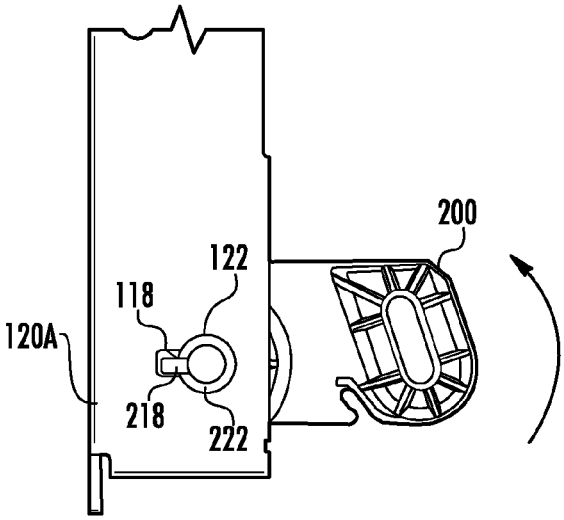
FIG. 8A is another partial side assembly view of a hinge pulley and hinge plate according to an exemplary embodiment of the invention.
Figure 8B:
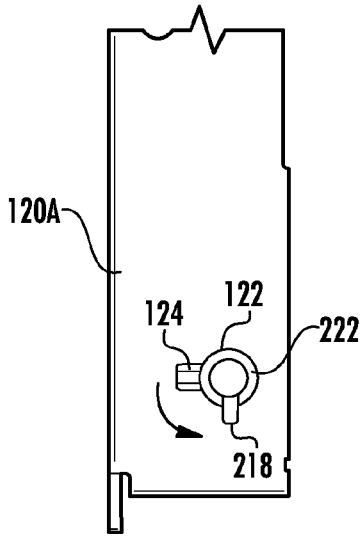
FIG. 8B is a partial side assembly view of the hinge pulley and hinge plate of FIG. 8A.
Figure 9A:
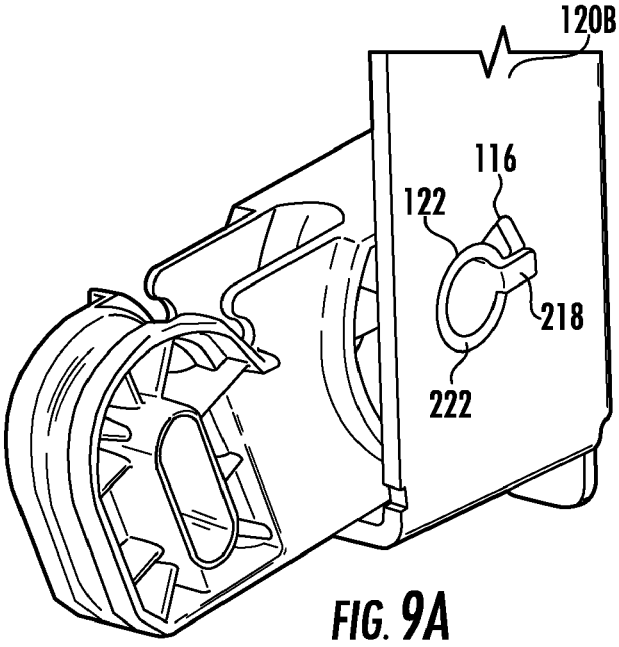
FIG. 9A is a partial perspective assembly view of a hinge pulley installed backward on a hinge plate according to an exemplary embodiment of the invention.
Figure 9B:
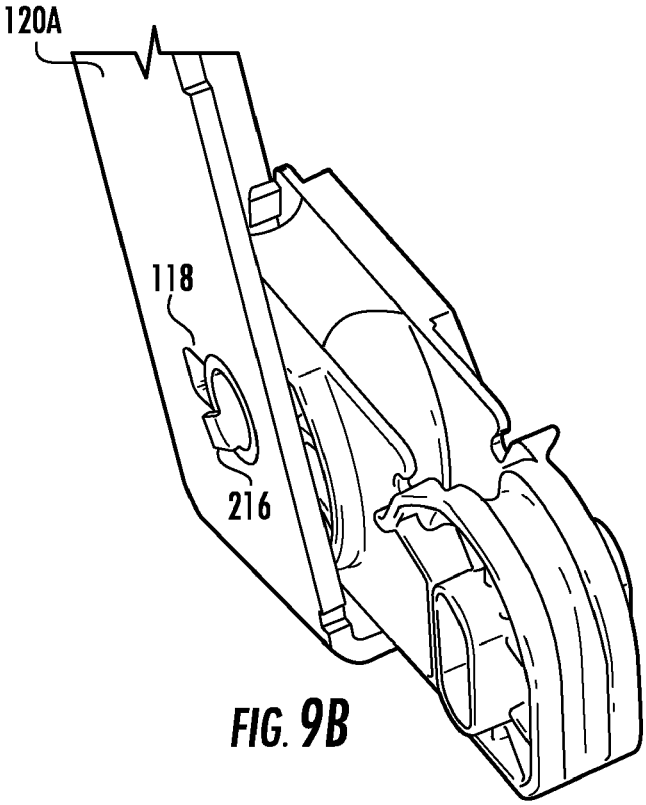
FIG. 9B is another partial perspective assembly view of a hinge pulley installed backward on a hinge plate according to an exemplary embodiment of the invention.

As shown in FIGS. 8A and 8B, a second side of the housing 120 of the dishwasher can include a stamped metal hinge plate 120B having an opening 122 for receiving the axle 220 of the hinge pulley 200. In this case, the opening 122 can include a slot 118 that corresponds to the tab 218 when the hinge pulley 200 is installed correctly.

During assembly, the tab 218 and axle 220 are aligned with the opening 122 and the slot 118 and inserted therein, as shown in FIG. 8A. The hinge pulley 200 is then rotated upward (i.e., clockwise in FIG. 8A as shown by the arrow) into position such that the tab 218 engages the surface of the metal hinge plate 120A and locks the hinge pulley 200 on the metal hinge plate 120B, as shown in FIG. 8B. In this manner, the exemplary embodiment can provide a fastener-less hinge pulley 200 that can be secured to the metal hinge plate 120B without separate fastening means, such as screws or snap features.

Figure 12A:
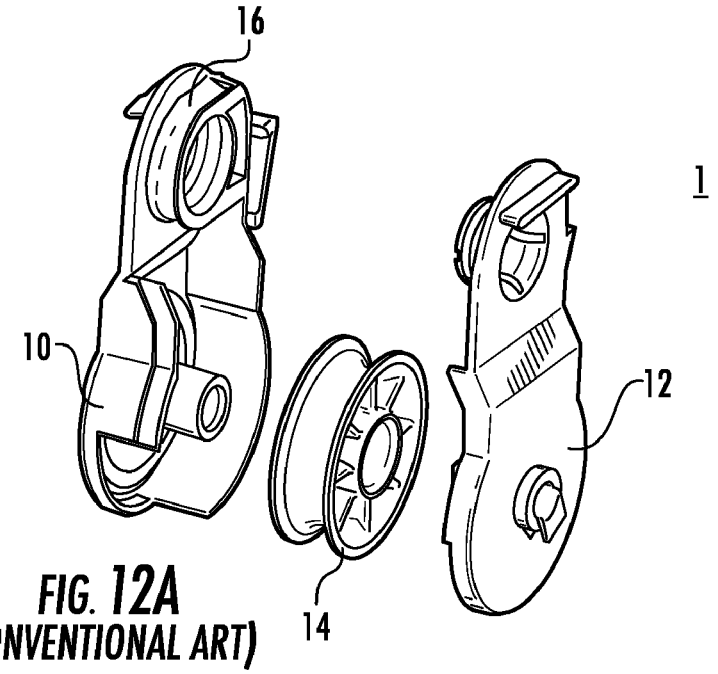
FIG. 12A (CONVENTIONAL ART)
FIG. 12A is an exploded perspective view of a conventional hinge pulley assembly.
Figure 12B:
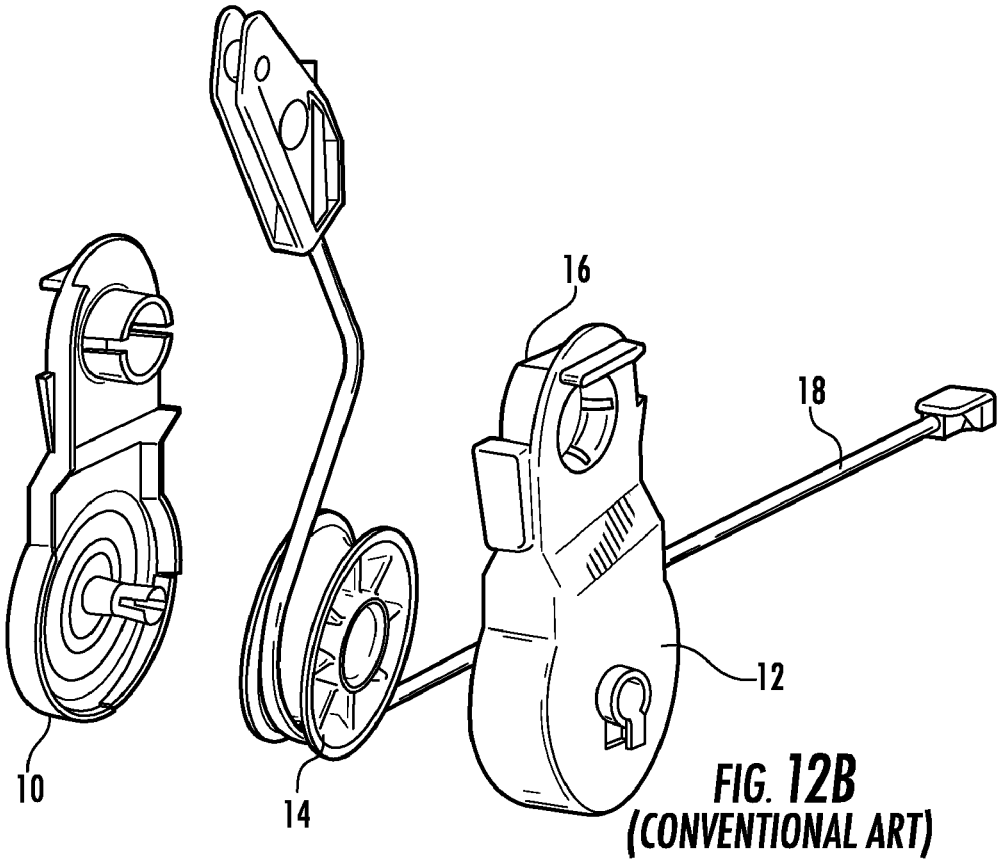
FIG. 12B (CONVENTIONAL ART)
FIG. 12B is an exploded perspective view of a conventional hinge pulley assembly.
Figure 12C:
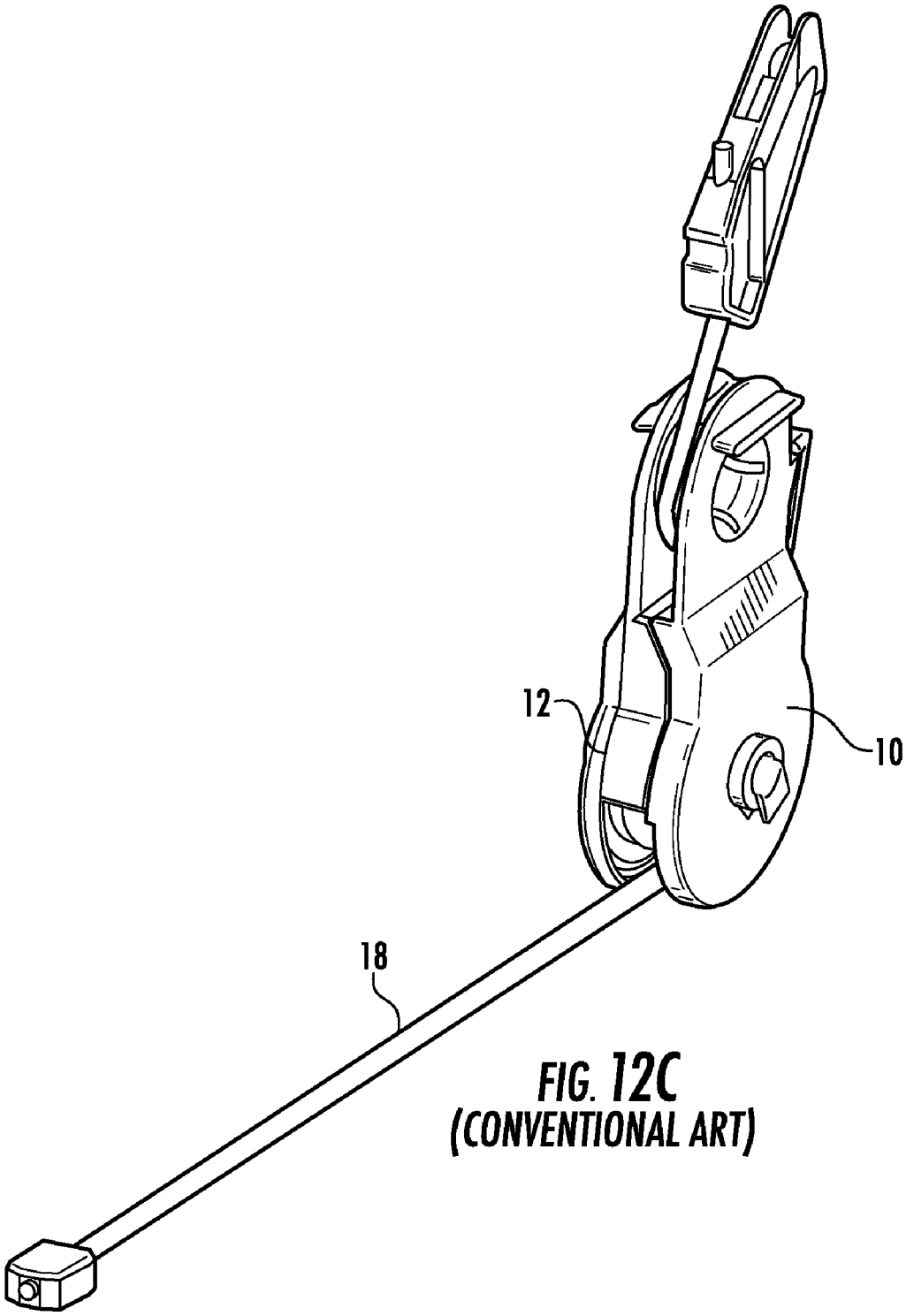
FIG. 12C (CONVENTIONAL ART)
FIG. 12C is a perspective view of a conventional hinge pulley assembly.
Figure 13:
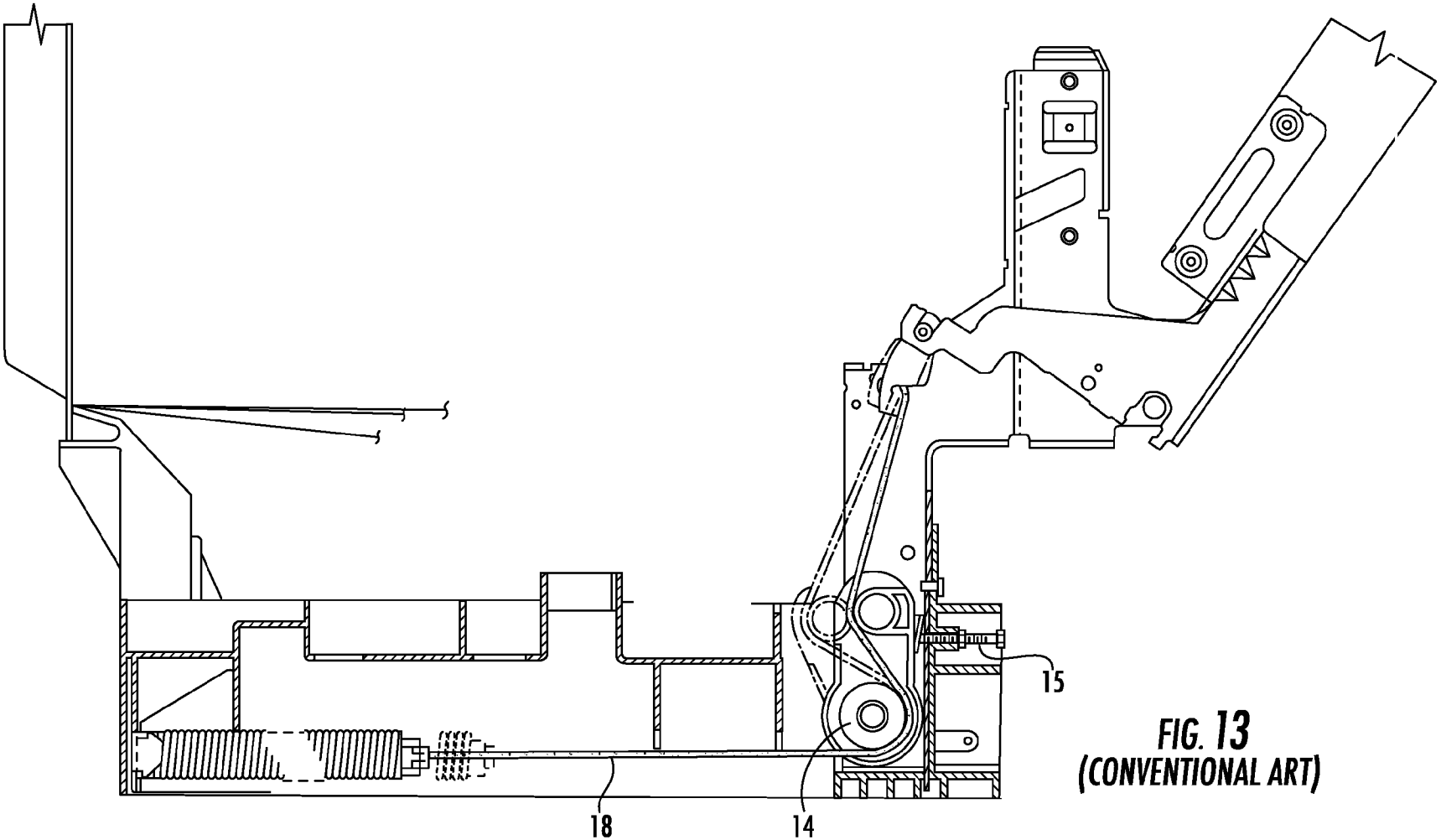
FIG. 13 (CONVENTIONAL ART)
FIG. 13 is a partial sectional view of a dishwasher having a conventional hinge pulley assembly.

Since the tabs 216, 218 are offset from each other, and since the slots 116, 118 correspond to the position of the respective offset tab 216, 218, the exemplary embodiment can minimize or prevent the incorrect installation of the hinge pulley 200 on the metal hinge plate 120A, 120B. For example, as shown in FIGS. 12A and 12B, if the hinge pulley 200 is installed incorrectly, the hinge pulley 200 interferes with the metal hinge plate such that the hinge pulley 200 cannot rotate properly into the locked position.

With reference again to FIGS. 3-5, the hinge pulley 200 can include a notch 226 formed in each sidewall 202A, 202B on a side that is adjacent to the sliding surface 206. The notch 226 can receive the transmission element 18 therein and hold the transmission element 18 to assist assembly and prevent the transmission element 18 from exiting or being withdrawn from the first fixation guide 212. In an exemplary embodiment, the notch 226 can include a narrow portion through which the transmission element 18 is forced through and a larger cutout portion for holding the transmission element 18 therein without pinching the transmission element 18.

In operation, the transmission element 18 can be installed in the fixation guide 21 of the hinge pulley 200 prior to installation of the hinge pulley 200 onto the household appliance on the assembly line. The transmission element 18 can be forced into the notch 226 and into the cutout portion such that the transmission element 18 is held therein without pinching the transmission element 18. In this manner, one of the notches 226 can be used to hold the transmission element 18 during transport of the assembled hinge pulley 200 and transmission element 18 to the assembly line. Alternatively, a vendor or supplier easily can ship the assembled hinge pulley 200 and transmission element 18 to the assembly plant, thereby avoiding a need for the hinge pulley 200 and the transmission element 18 to be assembled on the assembly line.

As shown in FIGS. 3-5, a notch 226 is formed on either side of the hinge pulley 200 such that the transmission element 18 can be secured on either side of the hinge pulley 200 depending on which side of the appliance the hinge pulley 200 is being installed upon. In this manner, the transmission element 18 can be secured in the notch 226 during the installation, thereby preventing the transmission element 18 from withdrawing from the hinge pulley 200 or interfering with the installation process.

With reference again to FIGS. 4 and 5, the hinge pulley 200 can include a bearing surface 224 adjacent to the open end of the U-shaped upper channel 204. In an exemplary embodiment, the bearing surface 224 can be formed at an angle $\alpha$ with the edge of the body 202, thereby lowing and correctly positioning a contact point where the hinge pulley 200 contacts the stamped metal hinge plate 120A, 120B when the hinge pulley 200 is rotated upright into a locked position.

The bearing surface 224 can provide a contact point for a setting screw for adjusting the position of the hinge pulley 200 when installed in the dishwasher and thereby adjusting the spring tension on the door. In this case, a setting screw (not shown) can be arranged on the housing 120 of the dishwasher to engage the bearing surface 224 of the hinge pulley 200. In order to increase the force of the tension spring S1, for example when a decor panel is fastened to the door 106 in order to match the domestic dishwasher to a kitchen unit front, which changes the weight of the door 106 which is to be balanced, the setting screw can be screwed in the direction of the hinge pulley 200. The setting screw can contact the bearing surface 224 and cause the hinge pulley 200 to be pivoted in the direction of the interior of the washing compartment 104 of the dishwasher 100, about the axis 220 of the hinge pulley 200. The transmission element 18 is carried along with the movement of the hinge pulley 200 since the transmission element 18 is resting on the sliding surface 206. As a result, the tension spring S1 is caused to expand, thereby achieving an increase in the force of the tension spring S1.

With reference again to FIGS. 3-5, an exemplary embodiment of the hinge pulley 200 can include a surface 228, such as a cut-off portion of the channel 208, that can provide clearance for the rotation of the hinge pulley from the position shown in FIGS. 7A, 8A to the locked position shown in FIGS. 7B, 8B.

Figure 10:
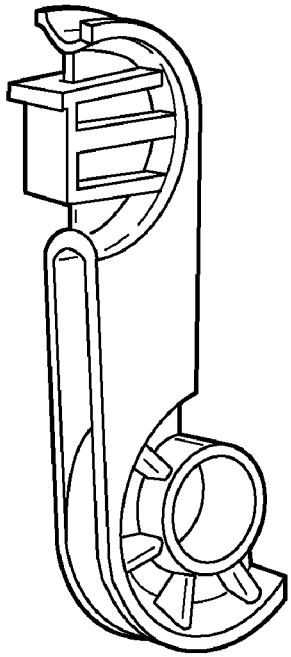
FIG. 10 is a perspective view of another hinge pulley.
Figure 11:
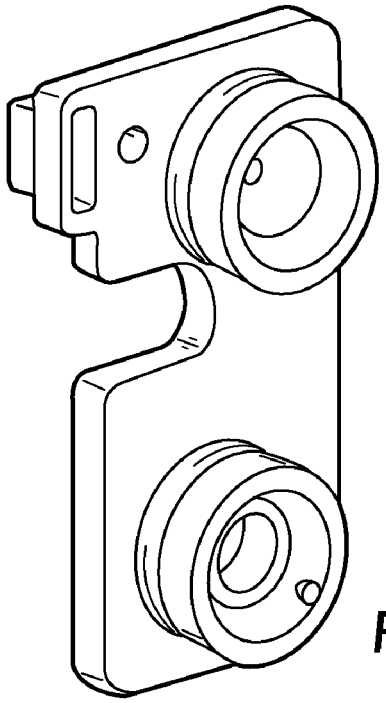
FIG. 11 is a perspective view of another hinge pulley.

FIGS. 10 and 11 illustrate alternative embodiments of a hinge pulley having one or more sliding surfaces formed from ultra high molecular weight (UHMW) material. In these embodiments, the entire channel area can be formed from the ultra high molecular weight (UHMW) material.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A hinge pulley for a household appliance having a housing, a washing container in the housing, a door pivotable about a horizontal axis at the lower part of the door between an open and a closed position for accessing an interior of the washing container, and a transmission element coupled between the door and the housing, the hinge pulley comprising a unitary molded body including:

an integral first channel having a first curved portion for guiding the transmission element;

an integral second channel having a second curved portion for guiding the transmission element;

a first fixation guide through which the transmission element is inserted to secure the transmission element to the hinge pulley; and a second fixation guide through which the transmission element is inserted to secure the transmission element to the hinge pulley, wherein the second fixation guide includes a pair of tabs separated by a gap;

wherein a portion of one of the integral first channel and the integral second channel includes a sliding surface formed from an ultra high molecular weight material.

2. The hinge pulley of claim 1, wherein the integral first channel and the integral second channel are formed from an injection molded thermoplastic, and wherein the sliding surface formed from the ultra high molecular weight material is overmolded over the integral first channel and the integral second channel formed from the injection molded thermoplastic.

3. The hinge pulley of claim 2, wherein one of the integral first channel and the integral second channel includes a recess, and wherein the sliding surface formed from the ultra high molecular weight material is overmolded into the recess of the one of the integral first channel and the integral second channel.

4. The hinge pulley of claim 1, wherein a portion of each of the integral first channel and the integral second channel includes a sliding surface formed from the ultra high molecular weight material.

5. The hinge pulley of claim 1, wherein only the sliding surface is formed from the ultra high molecular weight material.

6. The hinge pulley of claim 1, wherein the unitary molded body is formed from the ultra high molecular weight material.

7. The hinge pulley of claim 1, wherein the sliding surface extends substantially 180° around the curved portion of the one of the integral first channel and the integral second channel.

8. The hinge pulley of claim 1, wherein the sliding surface extends substantially 180° around the curved portion of the integral first channel and the integral second channel, and wherein a first line connecting ends of the 180° curved portion of the integral first channel is parallel to a second line connecting ends of the 180° curved portion of the integral second channel.

9. The hinge pulley of claim 8, wherein the integral first channel includes a linear portion that is substantially perpendicular to the first line and the second line.

10. The hinge pulley of claim 1, wherein an outer surface of each of the pair of tabs includes a tapered surface.

11. The hinge pulley of claim 1, wherein the unitary molded body includes an axle about which the hinge pulley can pivot, the axle including a first tab on a first side, and a second tab on a second side.

12. The hinge pulley of claim 11, wherein the first tab is offset from the second tab by a predetermined angle with respect to a center of the axle such that the first tab does not overlap the second tab.

13. The hinge pulley of claim 1, wherein the unitary molded body includes a first side wall and a second side wall, the first side wall being substantially parallel to the second side wall, wherein the first side wall and the second side wall include a notch for retaining the transmission element.

14. The hinge pulley of claim 13, wherein the notch includes a narrow opening portion through which the transmission element is forced through and a cutout portion for holding the transmission element therein without pinching the transmission element.

15. A household appliance comprising:

a housing;

a washing container in the housing;

a door pivotable about a horizontal axis at the lower part of the door between an open and a closed position for accessing an interior of the washing container;

a transmission element coupled between the door and the housing; and a hinge pulley coupled to the housing, wherein the hinge pulley includes:

an integral first channel having a first curved portion guiding a first portion of the transmission element;

an integral second channel having a second curved portion guiding a second portion of the transmission element;

a first fixation guide through which the transmission element is inserted to secure the transmission element to the hinge pulley; and a second fixation guide through which the transmission element is inserted to secure the transmission element to the hinge pulley, wherein the second fixation guide includes a pair of tabs separated by a gap, wherein a portion of one of the integral first channel and the integral second channel includes a sliding surface formed from an ultra high molecular weight material.

16. A hinge pulley assembly for a household appliance having a housing, a washing container in the housing, a door pivotable about a horizontal axis at the lower part of the door between an open and a closed position for accessing an interior of the washing container, and a transmission element coupled between the door and the housing, the hinge pulley assembly comprising:

a hinge pulley having a unitary molded body including:

an integral first channel having a first curved portion for guiding the transmission element;

an integral second channel having a second curved portion for guiding the transmission element;

a first fixation guide through which the transmission element is inserted to secure the transmission element to the hinge pulley; and a second fixation guide through which the transmission element is inserted to secure the transmission element to the hinge pulley, wherein the second fixation guide includes a pair of tabs separated by a gap, wherein a portion of one of the integral first channel and the integral second channel includes a sliding surface formed from an ultra high molecular weight material; and the transmission element coupled between the door and the housing and having a first portion resting on the integral first channel and a second portion resting on the integral second channel of the hinge pulley.

17. The hinge pulley assembly of claim 16, wherein the transmission element is one of a tape, a cord, a thermoplastic cord, and a braided polyester cord.

18. A hinge pulley assembly for a household appliance having a housing, a washing container in the housing, a door pivotable about a horizontal axis at the lower part of the door between an open and a closed position for accessing an interior of the washing container, and a transmission element coupled between the door and the housing, the hinge pulley assembly comprising:

a body including a first channel having a first portion for guiding the transmission element, a second channel having a second portion for guiding the transmission element, a first fixation guide through which the transmission element is inserted to secure the transmission element to the hinge pulley, and a second fixation guide through which the transmission element is inserted to secure the transmission element to the hinge pulley, the second fixation guide including a pair of tabs separated by a gap;

wherein the transmission element coupled between the door and the housing and having a first portion resting on the first channel and a second portion resting on the second channel of the hinge pulley.

19. A household appliance comprising:

a housing;

a washing container in the housing;

a door pivotable about a horizontal axis at the lower part of the door between an open and a closed position for accessing an interior of the washing container;

a transmission element coupled between the door and the housing; and a hinge pulley coupled to the housing, wherein the hinge pulley includes:

an integral first channel having a first curved portion guiding a first portion of the transmission element;

an integral second channel having a second curved portion guiding a second portion of the transmission element; and a fixation guide through which the transmission element is inserted to secure the transmission element to the hinge pulley, the fixation guide including a pair of tabs separated by a gap.

20. A hinge pulley assembly for a household appliance having a housing, a washing container in the housing, a door pivotable about a horizontal axis at the lower part of the door between an open and a closed position for accessing an interior of the washing container, and a transmission element coupled between the door and the housing, the hinge pulley assembly comprising:

a hinge pulley having a unitary molded body including:

an integral first channel having a first curved portion for guiding the transmission element;

an integral second channel having a second curved portion for guiding the transmission element; and a fixation guide through which the transmission element is inserted to secure the transmission element to the hinge pulley, the fixation guide including a pair of tabs separated by a gap, wherein a portion of one of the integral first channel and the integral second channel includes a sliding surface formed from an ultra high molecular weight material; and the transmission element coupled between the door and the housing and having a first portion resting on the integral first channel and a second portion resting on the integral second channel of the hinge pulley.

* * * * *